US009734804B1

(12) United States Patent
McCabe

(10) Patent No.: US 9,734,804 B1
(45) Date of Patent: Aug. 15, 2017

(54) DROP TUNER FOR FULCRUM TREMOLO

(71) Applicant: Geoffrey Lee McCabe, Hollywood, CA (US)

(72) Inventor: Geoffrey Lee McCabe, Hollywood, CA (US)

( * ) Notice: Subject to any disclaimer, the term of this patent is extended or adjusted under 35 U.S.C. 154(b) by 0 days.

(21) Appl. No.: 14/880,271

(22) Filed: Oct. 11, 2015

(51) Int. Cl.
*G10D 3/00* (2006.01)
*G10D 3/14* (2006.01)

(52) U.S. Cl.
CPC ..... *G10D 3/146* (2013.01)

(58) Field of Classification Search
USPC ..... 84/313
See application file for complete search history.

(56) References Cited

U.S. PATENT DOCUMENTS

| | | | |
|---|---|---|---|
| 1,475,345 | A | 11/1923 | Lambert et al. |
| 2,191,776 | A | 2/1940 | Schreiber |
| 2,976,755 | A | 3/1961 | Fender |
| 3,313,196 | A | 4/1967 | Mari |
| 3,407,696 | A | 10/1968 | Smith et al. |
| 3,599,524 | A | 8/1971 | Jones |
| 3,678,795 | A | 7/1972 | Fullerton |
| 3,763,736 | A | 10/1973 | Williams |
| 3,911,777 | A | 10/1975 | Rendell |
| 3,911,778 | A | 10/1975 | Martin |
| 3,915,049 | A | 10/1975 | Bean |
| 4,027,570 | A | 6/1977 | Rendell et al. |
| 4,037,506 | A | 7/1977 | How |
| 4,111,093 | A | 9/1978 | Field et al. |
| 4,135,426 | A | 1/1979 | Rickard |
| 4,142,435 | A | 3/1979 | Pozar |
| 4,171,661 | A | 10/1979 | Rose |
| 4,201,108 | A | 5/1980 | Bunker |
| 4,206,679 | A | 6/1980 | Wilson |
| 4,208,941 | A | 6/1980 | Wechter |
| 4,241,637 | A | 12/1980 | Brent |
| 4,283,982 | A | 8/1981 | Armstrong |
| 4,304,163 | A | 12/1981 | Siminoff |
| 4,348,934 | A | 9/1982 | Ogata |
| 4,377,101 | A | 3/1983 | Santucci |
| 4,389,917 | A | 6/1983 | Tiebout, III |
| 4,425,831 | A | 1/1984 | Lipman |
| 4,433,603 | A | 2/1984 | Siminoff |
| 4,457,201 | A | 7/1984 | Storey |
| 4,462,295 | A | 7/1984 | Hundley |
| 4,475,432 | A | 10/1984 | Stroh |
| 4,497,236 | A | 2/1985 | Rose |
| 4,522,101 | A | 6/1985 | Peavey et al. |
| 4,549,461 | A | 10/1985 | Rose |

(Continued)

*Primary Examiner* — Christopher Uhlir

(57) ABSTRACT

The Drop Tuner comprising a pivoting lever element and two ring-like elements in an arrangement operable to quickly alter the position of a macro-tuner or other string tuning element on the instrument body to change the tension of a musical instrument string from one pre-selected pitch to another and back by moving the lever to one of two corresponding adjustable pre-selected positions. "Drop Tuner" refers to an adjustment device added to a string tuner element, macro-tuner or similar, with the capacity to quickly change from one adjustable predetermined pitch to another adjustable predetermined pitch and back comprising at least two adjustable predetermined tensioning positions.

13 Claims, 4 Drawing Sheets

(56) References Cited

U.S. PATENT DOCUMENTS 4,555,970 A 12/1985 Rose
4,573,391 A 3/1986 White
4,608,904 A 9/1986 Steinberger
4,608,905 A 9/1986 Takabayashi
4,608,906 A 9/1986 Takabayashi
4,632,005 A 12/1986 Steinberger
4,638,708 A 1/1987 Kamal
4,638,711 A 1/1987 Stroh
4,648,304 A 3/1987 Hoshino et al.
4,656,915 A 4/1987 Osuga
4,674,389 A 6/1987 Fender
4,677,891 A 7/1987 Gressett, Jr. et al.
4,681,011 A 7/1987 Hoshino
4,686,883 A * 8/1987 Piche ..... G10D 3/146 84/297 R
4,690,027 A 9/1987 Ido
4,696,218 A 9/1987 Hoshino et al.
4,712,463 A 12/1987 Kubicki et al.
4,724,737 A 2/1988 Fender
4,768,415 A 9/1988 Gressett, Jr. et al.
4,779,506 A 10/1988 Takeuti
4,793,236 A 12/1988 McGuire et al.
4,803,906 A 2/1989 Fender
4,840,102 A 6/1989 Pittman
4,852,448 A * 8/1989 Hennessey ..... G10D 3/146 84/313
4,854,210 A 8/1989 Palazzolo
4,882,967 A 11/1989 Rose
4,905,563 A 3/1990 Davies
4,939,970 A 7/1990 Hoshino et al.
4,945,801 A 8/1990 Stroh et al.
4,967,631 A 11/1990 Rose
4,982,640 A 1/1991 Buscarino
5,012,716 A 5/1991 Pagelli
5,014,588 A 5/1991 Omata et al.
5,033,353 A 7/1991 Fala et al.
5,052,269 A 10/1991 Young et al.
5,072,646 A 12/1991 Valkama
5,097,737 A 3/1992 Uhrig
5,125,311 A 6/1992 Boulanger et al.
5,136,918 A 8/1992 Ribiloff
5,140,884 A 8/1992 Bowden
5,171,927 A 12/1992 Kubicki et al.
5,198,601 A 3/1993 McCabe
5,227,571 A 7/1993 Cipriani
5,265,512 A 11/1993 Kubicki et al.
5,277,095 A 1/1994 Steinberger
5,295,427 A 3/1994 Johnsen
5,337,643 A 8/1994 Cantrell
5,343,793 A 9/1994 Pattie
5,347,904 A 9/1994 Lawrence
5,347,905 A 9/1994 Cipriani
5,353,672 A 10/1994 Stewart
5,355,759 A 10/1994 Hoshino
5,372,057 A 12/1994 Hart
5,390,578 A 2/1995 Raymer
5,398,581 A 3/1995 Castillo
5,410,936 A 5/1995 Ellsworth et al.
5,413,019 A 5/1995 Blanda, Jr.
5,421,233 A 6/1995 Bunker
5,438,901 A 8/1995 Sperzel
5,452,637 A 9/1995 DeCola
5,458,035 A 10/1995 Okamura
5,477,764 A 12/1995 Carrico
5,519,165 A 5/1996 Gregory
5,522,299 A 6/1996 Rose
5,537,907 A 7/1996 Rose
5,539,143 A 7/1996 Rose
5,549,027 A 8/1996 Steinberger et al.
5,567,903 A 10/1996 Coopersmith et al.
5,589,653 A 12/1996 Rose
5,600,078 A 2/1997 Edwards
5,614,688 A 3/1997 Donnell
5,631,432 A 5/1997 Muncy
5,637,818 A 6/1997 Fishman et al.
5,637,823 A 6/1997 Dodge
5,661,252 A 8/1997 Krawczak
5,672,835 A 9/1997 Doughty
5,679,910 A 10/1997 Steinberger et al.
5,684,256 A 11/1997 Rose
5,689,075 A 11/1997 Rose
5,696,335 A 12/1997 Rose
5,700,965 A 12/1997 Rose
5,717,150 A 2/1998 Rose
5,739,444 A 4/1998 Borisoff
5,945,615 A 8/1999 Rose
6,046,393 A 4/2000 Rose
6,046,397 A 4/2000 Rose
6,051,773 A 4/2000 Rose
6,111,176 A 8/2000 Rose
6,137,039 A 10/2000 Rose
6,194,645 B1 2/2001 Rose
6,198,030 B1 3/2001 Rose
6,972,360 B1 * 12/2005 Ekin ..... G10D 1/08 84/297 R

* cited by examiner

DROP TUNER FOR FULCRUM TREMOLO

BACKGROUND OF THE INVENTION

In a stringed musical instrument, such as a guitar, the strings, placed under tension, extend unsupported between a first critical point usually formed by the nut positioned where the neck joins the head and a second critical point usually formed by a clearly defined point on the bridge positioned on the body. The strings are secured or fixed at one end on the body of the instrument to what is traditionally known as the tailpiece, strung over the bridge and extended past the nut at the transition from the neck instrument to the head, and, for conventional instruments, secured at the other end to the tuning pegs where an untensioned string is tensioned and adjusted to a tuned pitched condition, proper playing pitch for play, or, simply, tuned condition; sometimes a nut arrangement is provided for a headless or tuning peg-less design. The neck further comprises a fingerboard or fret board that a player presses the strings against to play various pitches up and down the neck; the fingerboard typically is formed with a convex radius that commonly varies between 9" and 16".

The second critical point can be created as a part of a bridge or combined bridge and tailpiece structure. Traditionally, the size of the bridge element is quite small so as to create a clearly defined single point of contact between the string and the bridge element. It is between these two points that the playable string length is typically determined, sometimes referred to as the scale length or harmonic length. Adjusting the relative distance between the first and second critical points is called harmonic tuning or setting the intonation. Some bridges structures are individually adjustable, that is for each string, relative to the nut for achieving a more precise harmonic tuning Usually this adjustment of the second critical point for harmonic tuning is carried out first and then the strings of the instrument are tuned to playing pitch. Often referred to the "initial setup", it is not uncommon that further adjustment of the harmonic tuning is necessary for a variety of reasons, for example, including changing the brand of a string where the alloy of the strings is varied or when the gauge of strings the player chooses changes as well as "setting" the string by manually pulling on the string along the scale length in order to improve elasticity in the string at first tensioning before the string can confidently relied on to hold proper playing pitch during the life of the string.

Often the typical construction of the strings, particularly for guitar and bass, includes a plain end and, on the other end, a "ball end" which being a washer-like addition is wrapped by the string itself into a larger form to enable "fixing" or securing the string on the instrument to the tailpiece element; alternatives to the "ball end" include as known to those of ordinary skill in the art as "bullet ends" formed from metal and molded around the end of the string. The tailpiece is usually provides for an opening or recess sufficient in size to receive the strings of various diameters ranging from 0.007" to 0.070" or more while being smaller than the diameter of the ball end so as to limit the passing of the ball end through the opening or recess in order to secure or mount each of the individual strings to the body. The wrapping usually extends up to a ½" towards the plain end and as such the position of the tailpiece structure relative to the bridge element must insure that the wrapping does not extend over the second critical point when arranged on the instrument; this wrapping, under normal circumstances, is not subject to stretch compared to the rest of the string. In the relevant art, "anchoring" strings is often referred to as attaching or securing a string and understood with the limitation that the anchoring is sufficient so that the string is fixedly attached or secured to the instrument under the typical tensioned conditions of the string that typically range from 16 to 20 lbs or greater. Stable fine adjustments of these and other elements have been a longstanding problem for stringed musical instruments.

Additionally, the popularity of guitars and other multi-stringed instruments having more than the typical 6 strings and/or using longer scale lengths, etc. are capable of a greater pitch range which creates the need for strings of a larger diameter. One solution is to utilize "taper core strings" that have one or two less layers of wrap near the "ball end" of the string to go over the bridge elements. Further, a "taper wound" string simply tapers away these layers of wrap as near the ball-end of the string, so the part that goes over the bridge has a smaller diameter. "Exposed core" strings taper down to the core itself, so the core goes over the bridge and lowers the action and increases sustain/resonance. These designs are often seen on B strings, typically a low string on a five string bass, for example. The logic is that a taper core string, etc. approach will help with intonating a larger diameter string. In some of these cases the strings are mounted to tailpiece portion by inserting the string through or over the bridge elements to avoid complications due to increased string diameter. The larger diameters can be problematic given the dimensions of vintage systems.

Playing pitch or proper playing pitch or pitched string condition is generally understood by one of ordinary skill in the art to be the proper pitch of a guitar string relative to the remaining guitar strings when a guitar is played "in tune." For example, in a standard tuning arrangement, for a six string guitar, based on the standard A=440 Hz, the playing pitch of the $1^{st}$ string (highest) is tuned to note E (329.63 Hz), the playing pitch of the $2^{nd}$ string is tuned to note B (294.94 Hz), the playing pitch of the $3^{rd}$ string is tuned to note G (196.00 Hz), the playing pitch of the $4^{th}$ string is tuned to note d (146.83 Hz), the playing pitch of the $5^{th}$ string is tuned to note A (110 Hz), and the playing pitch of the $6^{th}$ string is tuned to note E (82.41 Hz).

In the Proelsdorfer U.S. Pat. No. 2,304,597, string tensioning devices placed on the tailpiece for fine tuning the pitch of the strings of violins, guitars and the like, were disclosed; such pitch adjustment is quite limited in range, comprising generally an interval falling between that of a whole tone and a major third at best, and designed to offer the tuning of the strings a minor adjustment of pitch after the general tuning is achieved with the tuning pegs on the head of the instrument which traditionally first provides for raising and adjusting the tension of the strings to pitch from an untensioned condition and then setting the string. This is regarded as fine tuning and the apparatus for doing so, the "fine tuners", usually comprise an adjustment knob or thumb screw.

It is known to those skilled in stringed musical instrument design and construction that various tremolos have been proposed and utilized for varying the tension of all the strings simultaneously for the purpose of creating a tremolo sound. Further, it is known to those skilled in the art that there are a great many commonly used names for such devices, such as tremolo, tremolo device, tremolo tailpiece, tremolo bridge, fulcrum tremolo, fulcrum tremolo bridge, fulcrum tremolo tailpiece, fulcrum tremolo bridge-tailpiece, vibrato, vibrato bridge, vibrato tailpiece, vibrato bridge tailpiece, etc.

In one specific species, known as the fulcrum tremolo, first introduced in Fender U.S. Pat. No. 2,741,146 ("Fender '146") shows and provides a device comprising a novel structure, which incorporates the bridge and the tailpiece. The portion supporting the bridge elements is called the bridge plate or the base plate. Further, both the bridge and the tailpiece elements connected to the base plate both move together as the fulcrum tremolo device is pivoted. Accordingly, a singular and defining aspect of the fulcrum tremolo is that the harmonic tuning is upset as the device is pivoted; and, accordingly, for an instrument equipped with a fulcrum tremolo, it is unique in that only restoring all of the strings to a proper pitched condition also simultaneously restores the harmonic tuning for all the strings. The base plate upon which the individual bridge elements are adjustably secured has a beveled ridge portion which is secured to the instrument body by six screws permitting pivotal movement about a fulcrum axis which varies the tension on the strings and produces the desired "tremolo effect"; in general, this device allowed for extensive dropping down of the pitch of all the strings and a modest upward capacity that further enabled the familiar mild pedal steel or Hawaiian guitar vibrato effect provided in gentle pivoting.

In this first vintage fulcrum tremolo, herein referred to as Type I, the metal bridge elements of Fender '146 are loosely held in place by a spring loaded attachment screw arrangement pivotally secured through openings in a small folded portion of the base plate farthest from the fulcrum axis. The bridge elements also incorporate set screws for varying the relative height of the bridge elements and, therefore, height of the respective second critical points relative to the base plate and by extension, to the body and neck.

The fulcrum tremolo is generally defined to have a base plate pivotally mounted to the body of the instrument and an "inertia block" or "tone block" or "spring block" that extends transverse the direction of the strings 90° to the base plate. The instrument body is fashioned to include a body cavity comprising an approximate 3.00"×1.00", generally rectangular, traditional "tremolo pocket" or "trem pocket" extending generally perpendicular from the top surface of the body to meet at 90°, the traditional, generally rectangular, approximate 4.00"×2.25"×0.775" deep, cutout extending in the direction of the strings in the back of the instrument body, a "spring pocket", to receive the spring arrangement. The typical spring arrangement includes, in addition to the biasing springs connected to the spring block, a "spring claw" to receive the other end of the biasing element secured by two wood screws to adjust the position of the spring claw relative to the body for a simple but cumbersome adjustment method. There is ample room for the spring block to pivot freely within the cavity during use. Although there are differences in specifications from one instrument manufacturer to another for the various designs of the fulcrum tremolos that are available, there is approximately 0.125 to 150" clearance, between the spring block and the cavity face closest to the nut, to provide for upward pitch change as the spring block pivots towards the nut.

Typically, in order to facilitate the fulcrum tremolo pivoting about its fulcrum axis, counter springs, as a biasing element, are utilized to counteract or counter balance the pull of the strings. Counter springs are usually connected to the body of the instrument at one end and, on the other end, to a separate spring attachment means transverse the base plate, usually a block of metal, milled or cast or a combination of the two, which being secured to the bottom of the base plate by three screws 90 degrees to the base plate, is often called a spring block or inertia block.

One of the most troublesome problems with prior art for the fulcrum tremolo has been maintaining the "initial position" achieved at "initial setup" when all the strings are brought to proper playing pitch as the harmonic tuning is achieved. When a musician plays on the string there is usually some kind of string stretch over time that results in the overall tuning, and thereby, the "initial position" going out of balance. Specifically, when the pitch of the string changes, the position of the fulcrum tremolo and the position of the second critical point relative to the nut changes which then instantly alters the harmonic tuning. This is especially problematic if a string breaks with this type of tremolo; since the missing force otherwise created by the tension of the broken string allows the entire tremolo to be subject to the known "backward tilt", all the remaining strings are unmanageably sharp in pitch and the harmonic relationship to the fret placement and scale length is distorted, generally, to an undesirable degree.

This singular characteristic adds complexities in obtaining the primary goal of achieving a stable equilibrium between the force of the tension provided by the two to five biasing or counter springs (connected between the tremolo and the body) in relation to the force of tension of all the strings (connected to the fulcrum tremolo and the end of the neck at the peg head by the tuning pegs or an optional nut arrangement that secures the strings without tuning pegs, etc.)

Accordingly, these and other inherences need to be addressed in achieving a true and lasting initial position for the fulcrum tremolo and has been the object of many inventions. In this inherent inter-dependant system of tensioning forces, contrary to the requirements of other tremolo or fixed bridge arrangements, (in the ideal instance where the essential conditions of the initial setup have been established and the appropriate tensioning force of the springs provisioned), the precise tensioning to proper playing pitch for any less than the total number of strings will inherently fail to achieve pitch and harmonic tuning for all of those strings attached to the tremolo.

Initial position refers to the position of the fulcrum tremolo and, therefore, the position of the second critical point on the bridge elements in relation to the first critical point on the nut such that the tension of the strings, each at the intended proper pitched condition, and the appropriately tensioned counter springs, renders a specific equilibrium point wherein the harmonic tuning for all the strings is simultaneously achieved. Often the pivot is subject to wear and the tremolo does not always return to its initial position. Great care is required to establish the initial position, since both aspects of adjustment are interactive for "floating tremolo setups", and since it simultaneously provides both the proper harmonic tuning and proper pitch tuning for each of the individual strings in order to enable a lasting "initial setup".

Therefore, for stringed musical instruments, as is known to those skilled in the art:

- The second critical point is a clearly defined point on the bridge or individual bridge elements, the adjustment of which relative to the first critical point on the nut defines the length of the string or scale length and the adjustment of which is called harmonic tuning
- For fulcrum tremolos as originated by Fender U.S. Pat. No. 2,741,146, when pivoted:
- Both the bridge portions and the string anchoring means, the tailpiece, simultaneously move about a common fulcrum axis;

The harmonic tuning is upset and is only restored when all strings are at proper playing pitch;

The tuning pegs or other means of tensioning the strings are inter-dependant with each other in obtaining initial position; and Various factors can disturb the equilibrium point between the tension of the strings and the tension of the counter springs and as a consequence disturb the initial position.

For those fulcrum tremolos equipped with fine tuners as with Rose U.S. Pat. No. 4,497,236, Storey U.S. Pat. No. 4,472,750 and Fender U.S. Pat. No. 4,724,737:

The bridge and tailpiece portions simultaneously move about the fulcrum axis when the device is pivoted for the tremolo effect;

The fine tuner screws simultaneously move with the bridge and tailpiece portions about the tuning axis when fine tuning; and Fine tuners are designed to offer the tuning of the strings a minor adjustment of pitch after the general tuning is first achieved, typically, by the tuning pegs on the head of the instrument; and Adjusting the tension of a string by the fine tuner knob alone simultaneously adjusts the harmonic and pitch tuning and can achieve tuning a string to proper pitch conditions while simultaneously achieving proper harmonic tuning Improvements to the Fender '146 fulcrum tremolo have included Rose's "string clamps" at the nut, installed along with a "string tree" for some guitars, a horizontal bar positioned between the tuners and the "locking nut" arrangement, to facilitate stability and "string clamps" at a point on the opposite side of the intonation point or second critical point on each of the bridge elements relative to the nut in order to limit string stretch to the prime vibratory portion of the string within these two points defining the scale length.

Knife Edge Pivots for the Fulcrum Tremolo

Rose (U.S. Pat. No. 4,171,661) shows adopting a novel shaped beveled edge to the base plate, called a "knife edge", adjustably supported by two screw-like members, referred to generally as riser posts, positioned in the body to collectively improve the return to initial position after pivoting the fulcrum tremolo device. The knife edge fulcrum pivot arrangement provides for the base plate to be positioned generally parallel to the instrument body, often referred to as a "floating tremolo", for example, and offered the novel possibility to substantively increase the tension of the string for upward pitch changes by rocking the base plate "rearward towards the body" with the arm. The inclusion of iterations of Fender '146, herein referred to as Type I, to include, similar to Rose, a knife-edge design on the leading edge, closest to the nut, of the base plate with a riser post arrangement adjustably connected to the fulcrum tremolo, herein referred to as Type II.

These two vintage fulcrum tremolos of the last century, Fender in the 50's and Rose in the 70/80's, are in part distinguished by the differing standards for the placement of the riser posts, that receive each of the knife-edges to create a pivot axis, relative to both first critical point on the nut as well as the second critical point on the bridge element. Accordingly, there are differences in the body pocket but less so for the cutout that receives the biasing springs and the distance from the face of the spring block nearest the nut to the corresponding face of the tremolo pocket.

Stopped Tremolo

Referenced above, the floating tremolo is a setup preferred by many guitarists today that use a fulcrum tremolo and for this setup the Global Tuner invention offers a quick way to adjust the dynamic relationship between tensioning forces between the strings and springs to maintain "initial position" over time. Other mechanisms, often providing an additional compression spring-based arrangement, have been presented to augment traditional biasing element of Fender '146 in view of Type-II demands, such as Borisoff U.S. Pat. No. 4,928,564 ("'564"), commercialized as the Hipshot Tremsetter, to enforce the floating tremolo at initial position, so as to avoid frequent adjustment.

The Floating Tremolo, Stopped Tremolo and Global Tuners

Given the sensitivity of the floating tremolo at initial position, many players today would prefer a tremolo that acts like a fixed bridge for small force changes like bending a string with their hand at initial position yet "gives" and acts like a floating tremolo for larger modern, pitch changes, such as "dive bombs", etc. And yet, many other musicians, despite having the requisite hardware on their stringed instrument to enable a "floating tremolo" setup, intentionally choose to "block" or "stop" the fulcrum tremolo from being tilted "rearward", in order to remove the potential to increase the pitch of the strings from initial position, and is commonly referred to as a "blocked tremolo" or "stopped tremolo".

This choice to limit the range of the rotation of the tremolo in one direction when at initial position is predicated on at least three objectives: 1) when a string breaks, the tremolo stop will ensure initial position so that tremolo does not tip rearward and the remaining strings do not go up in pitch despite the missing counter balancing force of the un-tensioned or broken string that otherwise results in the tremolo tilting adversely, 2) ensuring the tremolo returns to initial position after radical use no matter what—the player is less concerned with, among other things indigenous to the floating tremolo, the maintenance and care of initial position over time defined by the delicate balance of the forces created by tension of the strings and springs over time and 3) makes the tremolo less likely to be activated in one direction unintentionally compared to a floating tremolo, useful in general, and makes double stops much more accessible when the force of the biasing element is increased but eliminates the capacity for light tremolo wavering effects around initial position.

Alternately, compression spring-like mechanisms are used to enforce the position of the fulcrum tremolo at initial position to assist the traditional biasing springs of Fender '146 in view of Type-II demands, such as the Hipshot branded "Tremsetter", Borisoff et al, U.S. Pat. No. 4,928,564 ("'564"). The Tremsetter device secured to the body's spring pocket, provides an adjustable pre-tensioned compression spring element added to the traditional biasing element to provide a discontinuous force curve exerted on the tremolo; its operability primarily capable within a range of just a few degrees of rotation in each direction from initial position and restores or more firmly maintains the position of the floating tremolo compared to usage with an unassisted biasing element. Accordingly, when the tremolo is at initial position it is subject to a restoring force that is being borne by the device limited enough in its range of focus so that the compression spring is active until the pre-stressed force is overcome.

The Hipshot device and multi-spring variations like it, Ibanez BackStop, WD Tremolo Stabilizer, ESP Arming Adjuster, Goeldo BackBox, not all of which are available in the US at this time, comprise a compression spring-like addition to the biasing element, each secured to the tremolo spring pocket in the body, operable to augment the biasing element, do not move with the pivoting action of the tremolo, to provide a "soft" stop or block. Each such device seeks to desensitize the fulcrum tremolo at initial position within a buffer of a few degrees of rotation so as to avoid frequent adjustment of the biasing element, facilitate light tremolo effects at initial position, and to offer more stability in the instance of double stops which are difficult with an unassisted biasing element due to the otherwise sensitivity of the floating tremolo setup

Drop Tuners

Auxiliary tension adjustment mechanisms, U.S. Pat. No. 5,359,144 10/94 ("'144") to Robert Benson:

> A pitch changing apparatus, providing bi-stable operation with a tremolo system which produces two distinct pitches for selected strings Commercialized as the "D-Tuna", specifically designed to work only with the "double-locking" Floyd Rose tremolos, the mechanism quickly re-tensions the $6^{th}$ string from standard "E" down a whole step to "D" for "Drop-D tunings", for example, and other instances where the pitch of at least one string is varied compared to standard tuning—the dynamics of the forces of tension between the strings and springs require, for optimal usage, a stopped tremolo, Edward Van Halen: (http://www.dtuna.com/faq.php)

> Why do the other strings go out of tune when I drop to D?
> The bridge must be stabilized first. This is done by blocking the bridge so it cannot pull up. If your bridge is stabilized and the other strings are still going out of tune, you may need to increase the overall "spring tension" by moving the spring claw further from the block.

Accordingly, it is recommended by Van Halen that the "D-Tuna" device of '144 works better with an additional element or mechanism that will stop the tremolo when the $6^{th}$ string is tuned to "D", the lower of the two target pitches; and, in order to ensure initial position of the fulcrum tremolo at the higher target pitch, increasing the overall force of the biasing element applied to the stop sufficient to compensate for the small increase in force, which otherwise unaddressed would yield a forward tilt, present at the higher-tensioned "E" target pitch. The Tremsetter and devices like it increase the inertia sufficiently at initial position in a floating tremolo setup to improve the accuracy of the two target pitches.

Further, Borisoff U.S. Pat. No. 5,097,736 A ("'736") discloses a device lever-like element for use with the traditional peg head or tuning peg arrangement and the small distances needed to affect the above changes:

> A tuning device includes a tuner housing ending from a string instrument, such as a guitar, with an integral orthogonal threaded mounting portion mounted in a peg head aperture.

Further,

> . . . when rotated a short distance quickly tunes the string of a musical instrument to a desired pitch.

There are no known auxiliary tension adjustment mechanisms for other tuning elements including but not limited to macro-tuners or locking macro-tuners for use on the body or fulcrum tremolos.

SUMMARY OF THE INVENTION

Drop Tuners The Drop Tuner is an auxiliary tension adjustment mechanism for string tuning elements on the body of the instrument including locking macro-tuners shown in McCabe 9/123,312 ("'312") September 2015. "Drop Tuner" refers to an adjustment device added to a string tuner element, macro-tuner or similar, with the capacity to quickly change from one adjustable predetermined pitch to another adjustable predetermined pitch and back comprising at least two adjustable predetermined tensioning positions.

A first preferred embodiment provides an apparatus comprising a cam-based lever element, the cam comprises an offset extending in a direction towards the free end, a first ring-like element formed to comprise a support bracket to support the cam-based lever for the pivotal adjustment requirement and a second ring-like element fashioned to comprise a stop comprising the tip of the setscrew. The setscrew arrangement finely adjusts the offset of the first ring-like element relative to the second ring-like element. Accordingly, flipping the lever variably engages the cam with the stop to slideably reposition the tuner pin/knob arrangement from a first adjustable preselected pitch to a second adjustable preselected pitch. The mechanism is typically connected to a tuning mechanism used for the $6^{th}$ or lowest-pitched string.

Accordingly, a first position wherein the lever element in a direction away from the bridge element, the offset is disengaged so that the face of each of the two ring-like elements make contact establishing a base position for the tension requirement for the lower of the two adjustable pre-selected pitches. Flipping the lever in an opposite direction towards the bridge element, approximately 180°, activates the adjustable offset to quickly change the spatial arrangement between the tuner body and the pin/knob arrangement to achieve a higher second adjustable pre-selected tension associated to a second adjustable pre-selected higher target pitch. Reversing the lever to first position will restore the first adjustable pre-selected pitch.

Another embodiment includes inter-cooperative rings, positioned between the tuner knob and the end of the macro-tuner body, each partially formed with gradients, slopes or tapered provisions in the mating surfaces of the rings, making variable bearing contact with each other, to change the tension of a string. By rotating one ring from one limited position to a second limited position, the gradient feature is activated. The rotating rings can include levers or partial thumbwheel-like provisions, etc. to facilitate rotating and the fixed ring can include lever stops comprising adjustment screws or similar arrangements, etc.

Accordingly, using the lever to rotate the ring from a first position, closest the $5^{th}$ string, where the first pre-selected tuning is achieved, away from the $5^{th}$ string causes a change in the spatial arrangement between the two rings to adjust the position of the tuner pin/knob arrangement to a second pre-selected position at higher a tension associated to a second higher pre-selected target pitch. Reversing the rotating action will position of the lever and the position of the second ring back to its starting position adjacent the $5^{th}$ string to restore the first pre-selected pitch. Accordingly, the second ring-like element operable to be rotated by a plain lever element to alter the position of the first ring-like element relative to the second ring-like element to vary the relative distance between the tuner element and the nut and, thereby, alter the pitch of the string.

Additional provisions can be had to further refine the apparatus such as integrating the requisite stop element and gradient into the knob end of a macro-tuner body, for example, so that the remaining basic elements are the second ring with its gradient and lever provision, a washer and the tuner knob to complete the assembly. Alternatively, the rings could comprise very fine inter-cooperative threads, instead of the gradient slopes, by which a similar lever/stop arrangement could used to successfully reposition the tuner pin.

The improved locking macro-tuner mechanism is shown comprising an articulated extended tip of extended lever-like clamp improvement to facilitate threading a string through the nose slot to pivot or lift the clamp lever for successful loading of the string from a direction opposite or distinct from the traditional direction of operation carried out from the direction the tailpiece portion securing the string to the instrument.

Figure 3A:
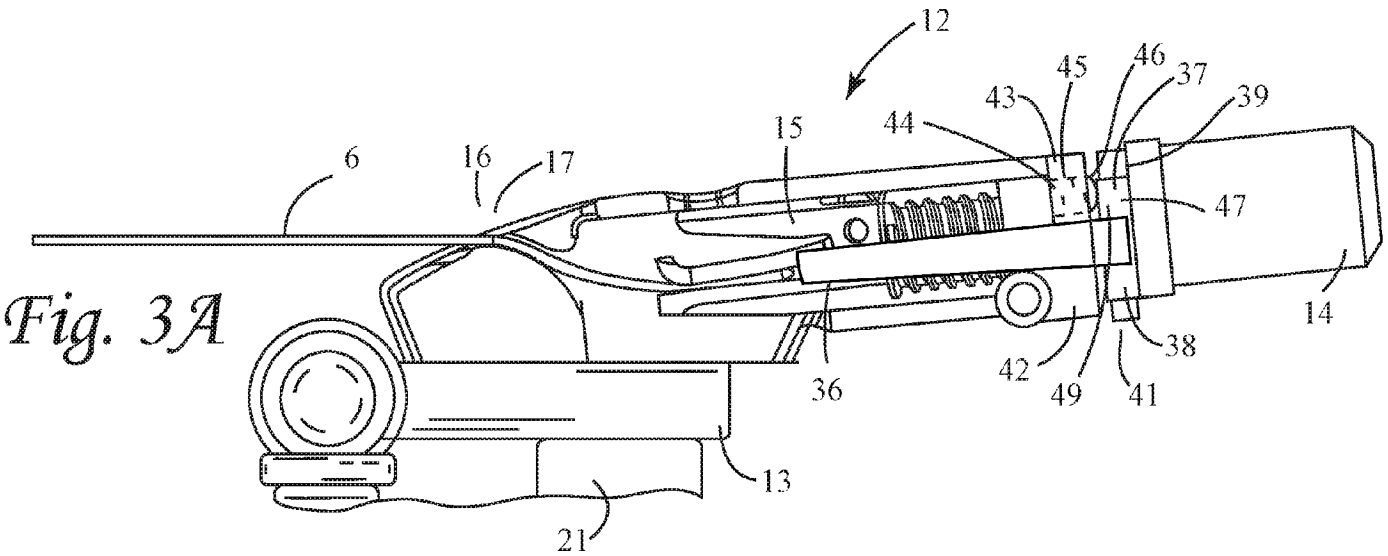
Figure 3B:
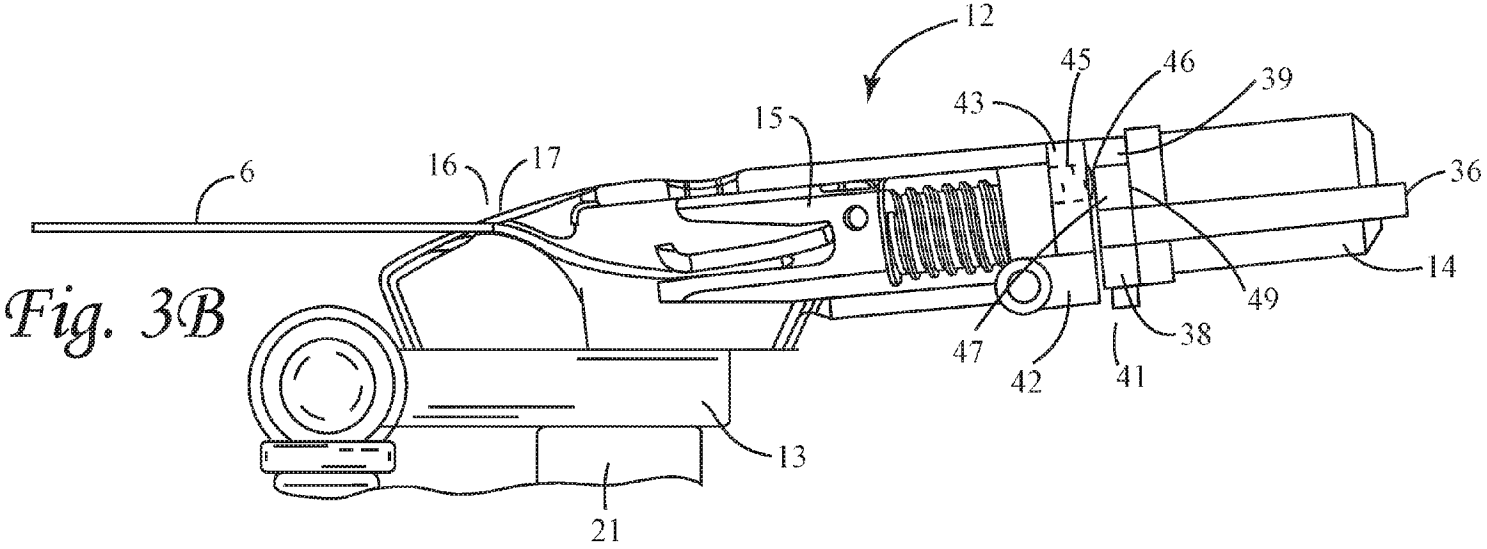

FIGS. 3A and 3B shows a preferred embodiment of the Drop Tuner, an auxiliary string tension adjustment mechanism, capable of quickly changing the tension of a first pre-selected pitch to second pre-elected pitch and back to the first pre-selected pitch for tuning mechanisms in general, and macro-tuners, in particular. The Drop Tuner is shown positioned between the end of the macro-tuner body and the tuner knob. FIG. 3 A shows one position of the lever holding an adjustable predetermined higher pitch, say, "E", and, FIG. 3B shows alternative position for an alternative adjustable predetermined lower pitch, say "D". Flipping the lever from the first position to the second position will quickly change tension, and thereby, pitch held by the tuning element.

Figure 4:
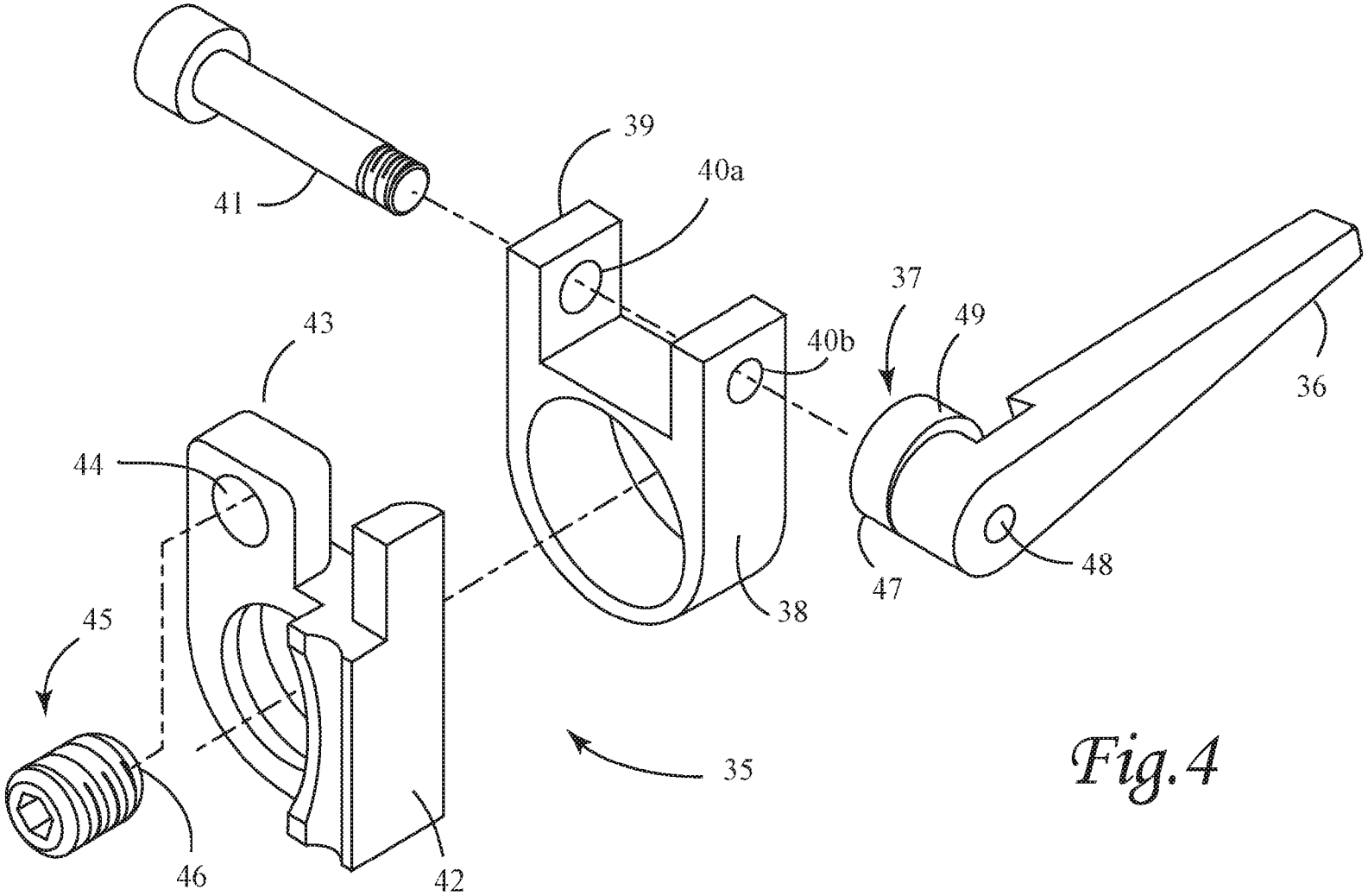

FIG. 4 shows an exploded perspective view of the elements associated with the preferred embodiment of the Drop Tuner. The apparatus comprising a rotatable cam-based lever, supported by a mounting assembly comprising two ring-like elements, is positioned between the end of the macro-tuner body and the tuner knob. A first-ring like element pivotally supports the cam-based lever. A second ring-like element provides a surface for the cam and, can, further, include lever stops comprising adjustment screws or similar arrangements, etc, to increase accuracy of limiting at least the second position of the mechanism. Flipping the lever from a first position to second position will change the relative position of the first ring to the second ring to reposition the tuner knob and tuner pin arrangement relative to the nut operable to switch accurately between two pre-selected pitches. A partial thumbwheel or partial cylindrical shape could be used to substitute for the lever.

DETAILED DESCRIPTION OF THE INVENTION

Figure 1:
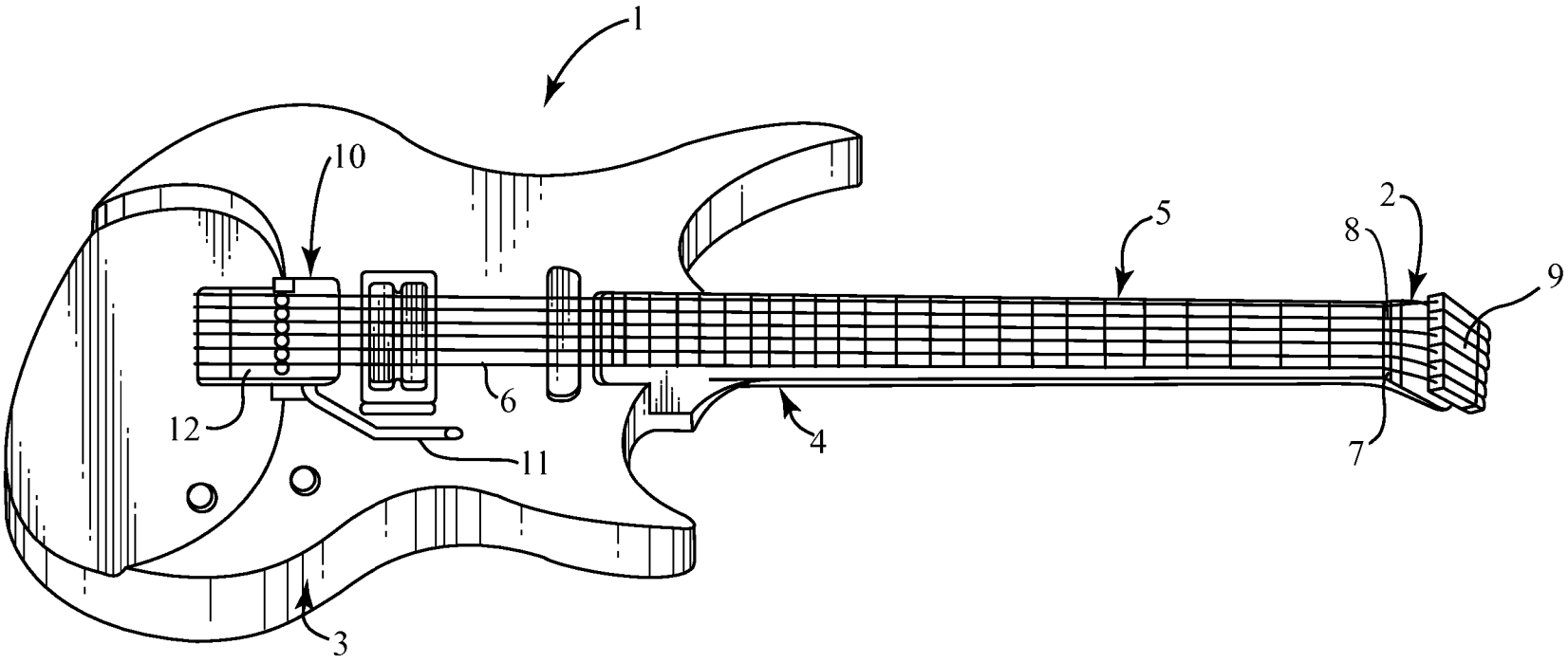
FIG. 1 is a plan view of an electric guitar embodying the present inventions.

In FIG. 1, an electric guitar 1 is illustrated comprising head 2 at one end, a body 3 at the other end, with neck 4 extending between head 2 and body 3. Six of each string 6 extends from head 2 to body 3 over neck 4. Neck 4 forms fret board or fingerboard 5 for guitar 1. At head 2, each string 6 extends over nut 7 forming first critical point 8 for each string 6. Nut 7 is located at the transition of neck 4 to head 2. Each string 6 is secured on head 2 by a corresponding tuning peg element 9. On body 3, strings 6 are secured to fulcrum tremolo 10. Fulcrum tremolo 10 has arm 11 for pivoting tremolo 10 to provide the vibrato effect on the strings. Fulcrum tremolo 10 has six intonation modules 12, one for each string 6. By manipulating tremolo arm 11, the entire fulcrum tremolo 10, not including the riser posts and inserts (and in varied designs, related bearing assembly elements) can be pivoted to achieve the desired tremolo effect.

Intonation module 12, shown as a macro-tuner, incorporating the function of bridge or saddle and tailpiece elements, is provided to support string 6. Intonation module 12 is slideably adjustable on base plate 13 to adjust the relative distance between first critical point 8 and second critical point 16 (FIG. 2) to adjust the harmonic tuning as such. Fulcrum tremolo 10 comprises a second critical point 16, one for each string 6, sometimes characterized as an intonation point, witness point or bridge point.

The invention is shown for on electric guitar 1 with six strings 6 and it should be understood that the invention could be used on a variety of stringed musical instruments. In body 3 of guitar 1 there are electric pickups shown without numbers. In the following description, fulcrum tremolo 10 will be described in greater detail.

Figure 2:
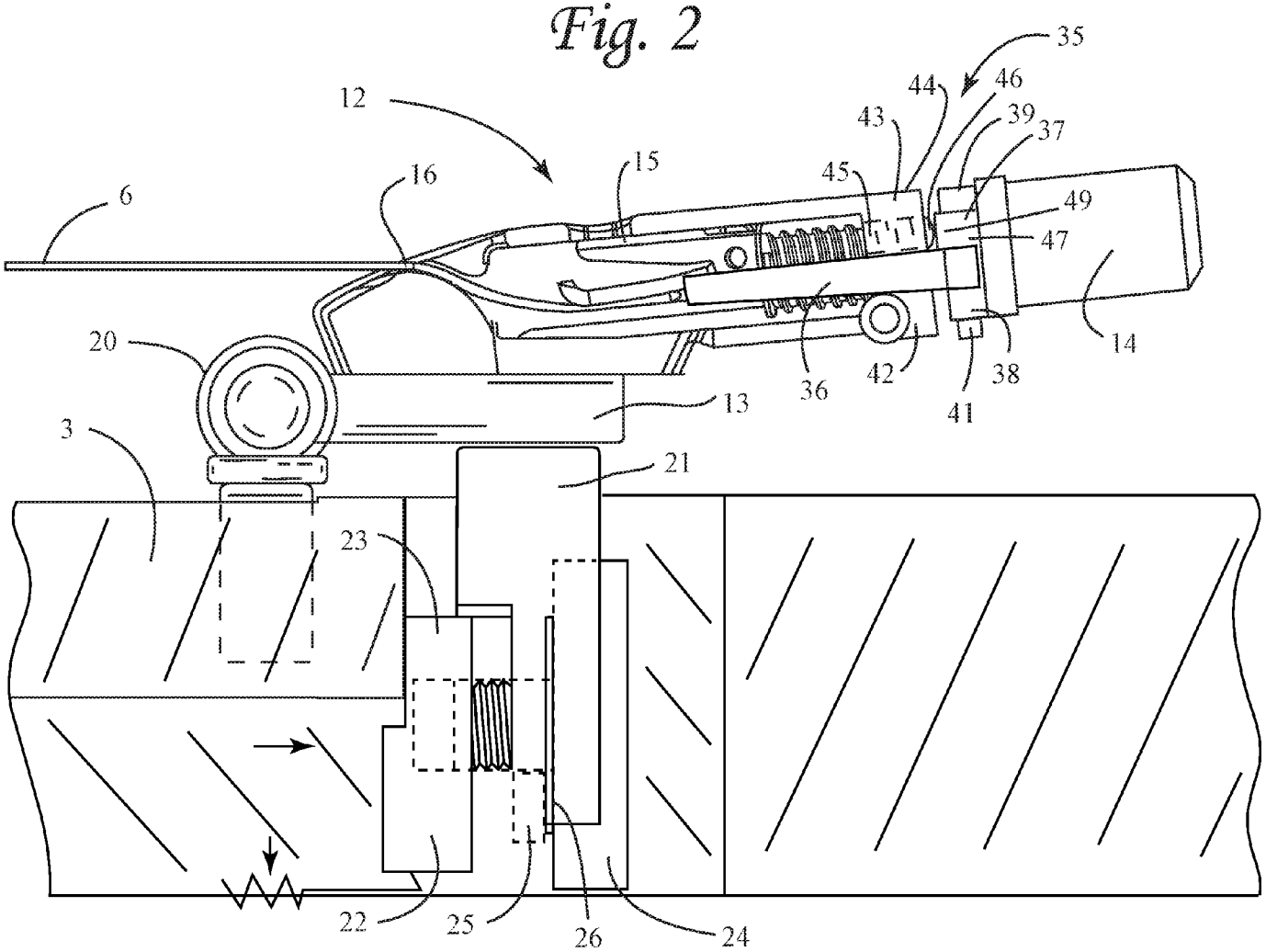
FIG. 2 is a side view of the tremolo mechanism showing the spring holder element advanced towards the riser posts and, therefore, the direction of the nut (not shown) in a position about 0.125" relative to the main inertia block. An extended portion of the holder element makes contact with the tremolo pocket. In this depiction, the spring holder element is shown in this position to block the rotation of the tremolo in one direction from initial position. A setscrew or adjustment member is shown threadedly connected to the base element to make variable contact with the thumbwheel shaft.

FIG. 2 displays fulcrum tremolo 10 in a partial cross-section side view showing body 3 further comprising tremolo pocket 28 and tremolo spring pocket 29, tremolo stop mechanism 20 and locking macro-tuner 12. Second critical point 16 is located on intonation module 12 at string opening 17. The leading-edge portion of base plate 13 (not shown) adjustably supports base plate 13 pivotally relative to body 3. Base element 21 connected to the base plate 13, holder element 22 including extended portion 23, thumbwheel 24, setscrew 25 and washer 26 comprise a spring block arrangement.

Apparatus 35 in profile comprising a rotatable lever 36, with cam portion 37 forming continuously variable surface 49 and smaller first surface stop portion 47, pivotally connected to first ring element or bracket element 38 by support pin 41 within first ring element opening 40 and lever pin opening 48 in first ring element or bracket element 38, to make variable contact with tuner knob 14. Second ring element or stop portion 42 operable to make variable contact with first ring or bracket element 38. Second ring element 42 provides setscrew 45 threadedly engaged with second ring element 42 threaded opening 44 in second ring support 43 to provide stop element 46 to make variable contact continuous variable surface 49 to modify the limiting at least one position.

Both FIGS. 3A and 3B display fulcrum tremolo 10 in a partial cross-section side view showing body 3 further comprising tremolo pocket 28 and tremolo spring pocket 29, tremolo stop mechanism 20 and locking macro-tuner 12.

Second critical point 16 is located on intonation module 12 at string opening 17. The leading-edge portion of base plate 13 (not shown) adjustably supports base plate 14 pivotally relative to body 3. Base element 21 connected to the base plate 13, holder element 22 including extended portion 23, thumbwheel 24, setscrew 25 and washer 26 comprise a spring block arrangement.

FIG. 3A shows a profile view of the preferred embodiment of Drop Tuner 35 on macro-tuner 12 where a position of rotatable lever 36 secured by first ring element or bracket element 38 by support pin 41 within first ring element opening 40*a* and lever pin opening 48 places continuous variable surface 49 of cam portion 37 to make bearing contact with alternate bearing surface 46 to displace first ring element 38 away from second ring element 42, and, thereby, tuner knob 14, to tension string 6. Stop provides setscrew 45 threadedly engaged with threaded opening 44 in second ring support 43 operable to vary at least one position. Stop portion 46 comprising the tip of setscrew 45 makes variable contact with the cam 37 continuous variable surface 49 to fine tune the tension of string 6 and, thereby, the pitch held by the tuning element. FIG. 3B shows a preferred embodiment of Drop Tuner 35 and another position of rotatable lever 36 secured by first ring element or bracket 38 places smaller first surface 47 to ensure alternate bearing surface 46 is no longer operable to make variable contact with cam contact area 47, to lessen the tension of string 6 and, thereby, the pitch held by tuning element 12 and head 2.

FIG. 4 illustrates in a perspective exploded view the individual parts comprising the Drop Tuner 35. The apparatus 35 comprising a rotatable lever 36 with cam portion 37 comprising offset 49 pivotally connected to first ring element 38 by support pin 41 within first ring element opening 40*a* and first ring element threaded opening 40*b* of bracket portion 39 and lever pin opening 48 (positioned between the end of the macro-tuner body and the tuner knob—not shown). Second ring element or stop portion 42 operable to make variable contact with first ring element 38. Second ring element 42 provides setscrew 45 threadedly engaged with second element 42 threaded opening 44 to provide stop portion 46 comprising the tip of setscrew 45 sample to make variable contact with cam 37 continuously variable surface 49 to increase accuracy of limiting at least one position. Flipping lever 36 from a first disengaged position to second position, generally 180° from the first position, will activate cam 37 cam contact area stop portion 47 to make to variably bearing contact to reposition tuner knob 14 and tuner pin 15 relative to nut 7 in order to switch accurately between two adjustable preselected pitches.

The various features of novelty, which characterize the invention, are intended to improve the upward spiral of Light and are pointed out with particularity in the claims annexed to and forming a part of this disclosure. For a better understanding of the invention, its operating advantages and specific objects attained by its use, reference should be had by the accompanying drawings and descriptive matter in which there are illustrations and described preferred embodiments of the invention.

While specific embodiments of the invention have been shown and described in detail to illustrate the application of the inventive principles, it will be understood that the invention may be embodied otherwise without departing from such principles.

I claim:

1. A stringed musical instrument comprising an apparatus for a fulcrum tremolo, the stringed musical instrument further comprising a body, a neck, a head, the neck extending outwardly from the body to the head, a plurality of strings extending from the body to the head, a nut to form a first critical point for each of the strings, a bridge element forming a second critical point for supporting each of the plurality of strings on the body, a head arrangement for securing the plurality of strings to the head and a tailpiece for securing the plurality of strings to the body, each the plurality of strings operable to be laced under tension for play, each of the plurality of strings placed under tension for play having a pitch, the fulcrum tremolo pivotally mounted on the body for pivotally supporting the plurality of strings, the fulcrum tremolo further comprising a macro-tuner element, the macro-tuner element comprising the tailpiece element for a string, the string comprising one string of the plurality of strings, the macro-tuner element operable to raise and adjust the string to pitch for play, the macro-tuner element further comprising a tuning arrangement variably connected to the body, the tuning arrangement comprising a tuning knob and tuning pin, the tuning knob threadedly connected to the tuning pin, the tuning knob operable to variably position the tuning pin to vary the tension of the string, the apparatus connected to the macro-tuner element, the apparatus further comprising:

a lever element, the lever element comprising a free end and a cam-like end, the cam-like end comprising a lever pivot axis, the cam-like end further including a first surface, and a second surface, the first surface generally aligning to the lever pivot axis, the second surface formed larger than the first surface, the second surface extending the cam-like end by the difference between the first surface and the larger second surface to form an offset, the lever element further comprising a first position, the first position comprising the offset generally extending in a first direction, the lever element further comprising a second position, the second position generally comprising the offset extending in a second direction, the lever element operable to variably rotate the offset between the first position and a second position, a first ring-like element, the first ring-like element comprising a bracket portion, the bracket portion to pivotally support pivoting of the lever element, a second ring-like element, the second ring-like element connected to the first ring-like element, the second ring-like element further comprising a stop portion, the stop portion operable to variably receive the offset, the second ring-like element further formed to secure the second ring-like element relative to the macro-tuner body, the first ring-like element and the second ring-like element further formed to receive a portion of the tuning knob and tuning pin arrangement therethrough, positioned between the macro-tuner body and tuning knob and tuning pin arrangement, the string tensioned to a pitch for play:

wherein pivoting the lever element to the first position is operable to activate the offset to make bearing contact with the stop portion to position the first ring-like element and, thereby, the tuning knob and tuning pin arrangement, away from the second ring-like element to quickly tension the string to obtain a pitch comprising a first adjustable predetermined tension, and wherein pivoting the lever element to the second position is operable to quickly position the first ring-like element, and, thereby, the tuning knob and tuning pin arrangement, adjacent to the second ring-like element to relax the string to obtain a pitch comprising a second adjustable predetermined tension.

2. The apparatus of claim 1 wherein the stop portion further comprises a setscrew, the setscrew threadedly connected to the stop portion, the setscrew operable to make bearing contact with the lever.

3. The apparatus of claim 1 wherein the offset comprises a continuous variable surface relative to the pivot axis.

4. A stringed musical instrument comprising an apparatus for a fulcrum tremolo, the stringed musical instrument further comprising a body, a neck extending outwardly from the body, a plurality of strings extending in a direction from the body to the neck, a nut to form a first critical point for each of the strings, a plurality of bridge element forming a second critical point for supporting each of the plurality of strings on the body, the fulcrum tremolo pivotally mounted on the body for pivotally supporting the plurality of strings, the fulcrum tremolo further comprising a tuner element for a string, the string comprising one string of the plurality of strings, the tuner element further comprising a tuning pin, the tuning pin comprising a tailpiece element, a tuning knob, the tuning knob threadedly connected to the tuning pin, the tuning pin variably connected to a tuner body operable to vary tension of the string, the apparatus connected to the stringed musical instrument, the apparatus further comprising:

a lever element, the lever comprising a free end and a pivoting end, the pivoting end comprising a lever pivot axis, a first ring-like element, the ring-like element comprising a bracket portion, the bracket portion to pivotally support the lever element, a second ring-like element, the second ring-like element connected to the first ring-like element, the second ring-like element further formed to limit a position relative to the fulcrum tremolo, the first ring-like element and the second ring-like element each formed to receive a portion of the tuning knob and tuning pin arrangement therethrough, positioned between the tuner body and tuning knob and tuning pin arrangement, the first ring-like element connected to the tuner knob, the first ring-like element connected to the second ring-like element, the second ring-like element connected to the tuner body, the string tensioned to pitch for play, the lever element operable to shift the first ring-like element to a first position away from the second ring-like element relative to the nut to quickly increase tension of the string to a pitch comprising a first adjustable predetermined tension, and, the lever element operable to release the first ring-like element to a second position contacting the second ring-like element to quickly decrease tension of the string to a pitch comprising a second adjustable predetermined tension.

5. The apparatus of claim 4 wherein the second ring-like element includes a stop portion operable to limit the lever element in the first position, the stop portion further comprises a variable surface, the variable surface further comprises a set screw, the set screw threadedly connected to the stop portion wherein the set screw operable to adjust the lever in first position to further adjust the pitch comprising a first adjustable predetermined tension.

6. The apparatus of claim 4 wherein the first ring-like element further forming a first cooperating portion, the second ring-like element further forming a second cooperating portion, the first cooperating portion in variable contact with the second cooperating portion in and between the first and second position, operable to vary the distance between the tuner element and the nut to vary the tension of the tuner element and, thereby, the pitch achieved.

7. The apparatus of claim 6 wherein pivoting the lever element is operable to rotate the first ring-like element relative to the second ring-like element to vary the distance between the tuner element and the nut.

8. The apparatus of claim 7 wherein at least the first cooperating surface or the second cooperating surface comprises a gradient.

9. The apparatus of claim 7 wherein at least the first cooperating surface and the second cooperating surface comprise a threaded portion.

10. The apparatus of claim 4 wherein the fulcrum tremolo includes a stop mechanism to impede the pivoting in one direction at initial position.

11. An apparatus for a stringed musical instrument, the stringed musical instrument further comprising a body, the apparatus located on the body, a head, a neck, the neck extending outwardly from the body to the head, a plurality of strings extending in a direction from the body to the neck, each of the plurality of strings placed under tension for play, each of the tensioned strings having a pitch, a nut to form a first critical point for each of the strings, a bridge element forming a second critical point for supporting each of the plurality of strings on the body, a head arrangement for securing the plurality of strings to the neck and a tailpiece for securing the plurality of strings to the body, the apparatus positioned on the body, the apparatus operable to variably secure one of each of the plurality of strings to the body, the apparatus further comprising:

an elongated element, the elongated element comprising a free end and a cam-like end, the cam-like end comprising a elongated element pivot axis, the cam-like end forming an offset, the elongated element further comprising a first position, the first position comprising the offset generally extending in a direction of the nut, the elongated element further comprising a second position, the second position generally comprising the offset extending in a direction opposite of the nut, the elongated element operable to variably rotate the offset between the first position and a second position, a bracket element, the bracket element to pivotally support pivoting of the elongated element, a stop element, the stop element operable to variably receive the offset to limit the pivoting of the elongated element, string tensioned to a pitch for play:

wherein placing the elongated element in the first position is operable to activate the offset to make bearing contact with the stop to position the bracket element to quickly tension the string to obtain a pitch comprising a first adjustable predetermined tension, and wherein placing the elongated element in the second position is operable to quickly relax the string to obtain a pitch comprising a second adjustable predetermined tension.

12. The apparatus of claim 11 further comprising at least one macro-tuner element for a string, the string comprising one string of the plurality of strings, operable to raise and adjust a string to pitch for play, the at least one macro-tuner element comprising a tuning arrangement variably connected to a macro-tuner body, the tuning arrangement comprising a tuning knob and tuning pin, the tuning knob threadedly connected to the tuning pin, the tuning knob operable to variably position the tuning pin within the macro-tuner body to vary the tension of the string and, therefore, the pitch held by the least one macro-tuner, wherein the bracket element and the stop element further formed to receive a portion of the tuning knob and tuning pin arrangement therethrough, positioned between the macro-tuner body and tuning knob and tuning pin arrangement.

13. The apparatus of claim 11 further comprises a fulcrum tremolo pivotally mounted on the body for pivotally supporting the plurality of strings.

* * * * *